United States Patent [19]

Phillips

[11] 4,061,877

[45] Dec. 6, 1977

[54] SPEAKER SYSTEM

[75] Inventor: William W. Phillips, Rancho Palos Verdes, Calif.

[73] Assignee: Shaymar, Inc., Beverly Hills, Calif.

[21] Appl. No.: 728,933

[22] Filed: Oct. 4, 1976

[51] Int. Cl.[2] ..... H04R 1/32

[52] U.S. Cl. ..... 179/1 E; 179/146 H

[58] Field of Search ..... 179/146 H, 1 E, 1 VE

[56] References Cited

U.S. PATENT DOCUMENTS

| | | | |
|---|---|---|---|
| 3,976,162 | 8/1976 | Cummings | 179/146 H |
| 4,020,284 | 4/1977 | Phillips | 179/146 H |

*Primary Examiner*—William C. Cooper

*Attorney, Agent, or Firm*—Kleinberg, Morganstern, Scholnick & Mann

[57] ABSTRACT

A stereo speaker system removably mountable on the back of a seat includes two speaker assembly enclosures pivotally mounted on a spacer bar to maintain the speakers at a desired separation and orientation and a strap for securing the enclosures and spacer bar to the back of the seat. Each enclosure includes a chamber substantially occupied by a speaker assembly and a duct portion for directing the sound.

10 Claims, 12 Drawing Figures

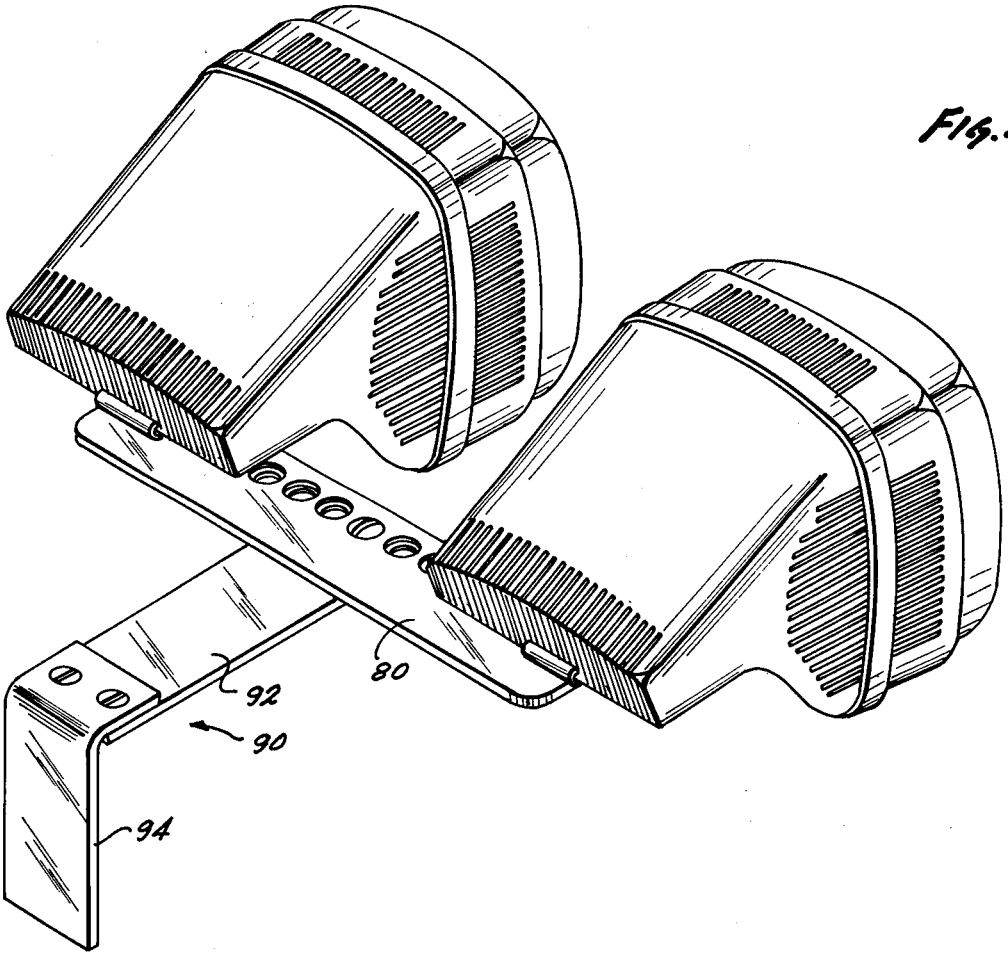
Fig. 11
Fig. 12
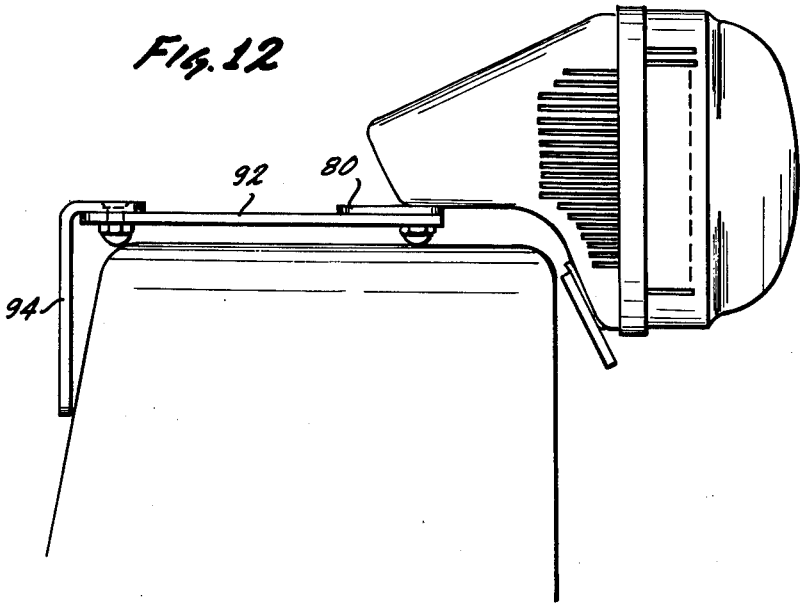

SPEAKER SYSTEM

RELATED APPLICATION

This application is related to copending application Ser. No. 624,607, filed Oct. 22, 1975.

BACKGROUND OF THE INVENTION

1. Field of the Invention

The present invention is in the field of loud speaker systems and particularly relates to a stereo speaker system which is especially well adapted for mounting to the back of a seat.

2. The Prior Art

It has long been known in the art that a unique synergistic effect results when two loud speakers are used to reproduce the sounds picked up respectively by two separated microphones. The listener is subjected to the illusion that the reproduced sound is originating at various points around him. Recently it has become known that this effect can be enhanced by the use of four rather than two sound channels to produce a so-called quadraphonic sound.

It is well known that loud speakers can be mounted in a wide variety of locations. U.S. Pat. No. 3,230,320 to Kerr, shows a speaker mounted on each side of the head rest of a dental chair. U.S. Pat. No. 3,237,713 to Leslie, shows two speakers mounted on opposite sides within a helmet-like acoustical chamber for providing individualized instructions to a student in a classroom. In U.S. Pat. No. 2,541,980, Antone shows a single loud speaker mounted to a hair dryer. All three of these inventions tend to limit the sideward vision of the listener and to limit his ability to move about.

A number of inventions have placed speakers in vehicles for various purposes. U.S. Pat. No. 1,997,408 to Holmes, shows a single speaker attachable to the back of a seat on its front surface at one side and positionable vertically relative to the listener's ear. In U.S. Pat. No. 3,158,835 shows speakers mounted on the inside of a car closest to the operator's left ear and on the interior top of the car an equal distance from the operator's right ear for use in a safety device to permit the driver to sense the sounds outside the automobile. U.S. Pat. No. 2,908,766 to Taylor, shows a pair of speakers mounted on the front side of a seat back on the left and right sides of a passenger's head. These three inventions all have in common the disadvantage that the passenger's sideward vision is obscured by the speakers, and in the event the vehicle lurches sidewardly, the passenger's head will be thrown against the speakers.

An alternative to speakers is the use of head phones. Unfortunately, head phones are not comfortable to wear for long periods of time, and they restrict the ability of the listener to move about freely. Certain types of head phones interfere with the listener's coiffure. When used in a vehicle, head phones are definitely a hazard because they shut out all outside sounds, whether or not the head phones are in operation.

Thus, the need can be seen for a stero speaker system which does not obscure the listener's vision, which does not restrain his freedom of movement, and which, when mounted in a vehicle, will not shut out all outside sounds and which will not present a safety hazard to the listener in the event of a crash.

Commercially, it is highly desirable that the stereo speaker system include means for mounting it to a portion of the vehicle in which it is to be used. Because of the great variety of vehicle shapes and styles, the mounting means must be extremely versitile and must be capable of securing the speaker system to the chosen portion of the vehicle to prevent the speakers from coming loose and presenting a safety hazard.

SUMMARY OF THE INVENTION

The speaker system of the present invention cannot obscure the listener's vision because it is normally mounted behind the listener at a point below the listener's eye level. It presents no physical constraints on the listener's ability to shift his position or otherwise move about. When used in a vehicle, the speaker system of the present invention does not shut out outside sounds, and, because of the way it is mounted — on the seat back — it presents no impact hazard to the listener. The system is removably attachable to the listener's seat in one embodiment, and can be removed from the seat and taken outside the vehicle for entertainment. Alternatively, the system can be unplugged from the vehicle for use elsewhere with another stereo or nonaural system. The system generates a unique quality of sound which can be felt as well as heard.

The speaker system of the present invention is intended for operation with two-channel or four-channel stereo systems with or without the use of additional speakers. The system may, of course, be operated monaurally by feeding identical signals to both speakers.

The system comprises at least two loud speakers, one for the left channel and one for the right channel. These speakers are mounted in unique enclosures (housings).

The enclosures are of a relatively rigid material such as plastic and are only slightly larger than the speaker, so that each speaker occupies an appreciable fraction of the volume within its enclosure. The walls of the enclosures reverberate from the sound produced and this reverberation can be felt by the listener on his back and in his chest cavity. The dimensions of the enclosures are smaller than the wavelength of all but the higher pitched sounds and as a result, little interference takes place, although there is a general enhancement of the base frequencies. Each enclosure narrows to form a duct through which the sound is channelled and from which the sound is transmitted. The duct produces a trumpet effect which tends to direct the sound from the left speaker toward the listener's left ear and to direct the sound from the right speaker to the listener's right ear.

In general, the speakers are located behind the listener and at shoulder level approximately. The ducts normally direct the sound in a forward and upward direction toward the listener's ears. The theory of the speaker system is based on the realization that the stereo effect is based upon the phase differences between the channels during reproduction, rather than on the direction from which the sound waves actually originate as in "live listening".

The speaker system produces a unique quality of stereo sound, described as clear and brilliant but with a firmer and louder bass compared to conventional systems.

In one embodiment, portions of the exterior of the enclosure are provided with a layer of foamed plastic both to protect the enclosure, and if the system is used in a vehicle, to prevent passengers of the vehicle from being injured by the enclosure in the event of a crash.

With the system of the present invention, outside sounds are not shut out. The listener can hear the outside sounds, particularly if he chooses to concentrate on them. This is in contrast to the situation with head phones, where the outside sounds are never available to the listener's ears. Thus, if mounted in an automobile, the present invention would not prevent the listener from hearing the sounds produced by emergency vehicles and other traffic sounds, as would head phones. Because the speaker system of the present invention is not worn on the listener's head, it cannot spoil the listener's coiffure.

In a preferred embodiment of the present invention, each of the two speakers has its own enclosure. The enclosures, in turn are pivotally attached to a spacer bar near its ends. In a preferred embodiment, the length of the spacer bar, which determines the separation between the speakers is adjustable to facilitate mounting the speaker system on the backs of seats of various types.

In an alternative embodiment, two spacer bars connect the speaker enclosures, which are not pivotally mounted. This alternative configuration is particularly useful where the duct portions of the enclosure are positioned in a forward direction and extending forward over the horizontal top surface of the back of a seat.

The mounting system according to the present invention permits the speaker system to be mounted conveniently on seats having a head rest. With the present invention, the head rest facilitates mounting the speaker system.

In both the preferred embodiment and in the alternative embodiment, the speaker system is attached to the seat back by means of a strap. The strap is attached to the speaker system in some applications through apertures in the speaker enclosures, while in other applications, the straps are attached to the spacer bars by means of apertures in them.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 11 is a perspective view of an alternative embodiment of the speaker system in which a special bracket is provided for mounting the system on a particular type of seat back; and, FIG. 12 is a side elevation view of the system of the system of FIG. 11 mounted on a seat back.

DESCRIPTION OF THE PREFERRED EMBODIMENT

Figure 1:
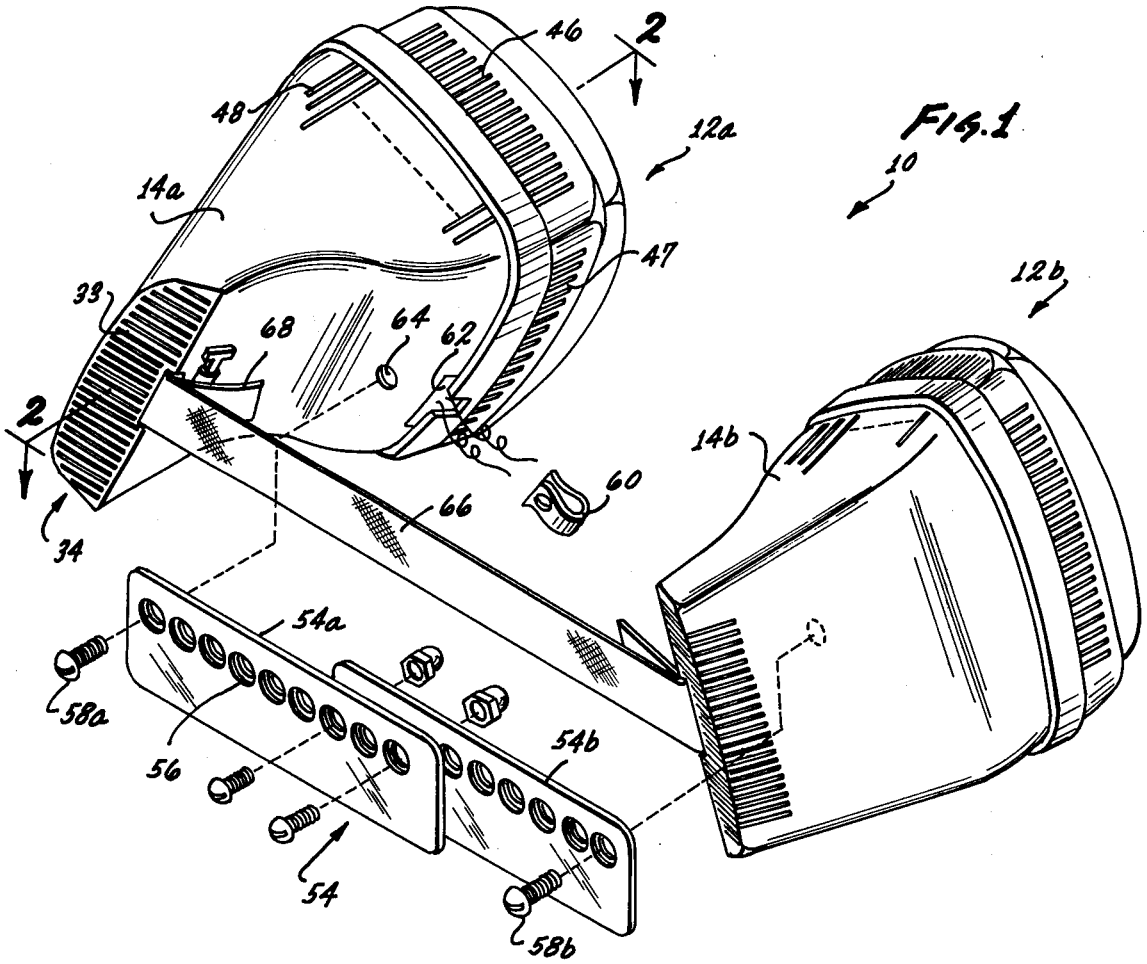
FIG. 1 is a perspective view of a preferred embodiment of the present invention.

Turning now to the drawings, there is shown in FIG. 1 a perspective view of a preferred embodiment of the present invention. The speaker system 10 includes two enclosures 12*a* and 12*b* containing the loud speaker assemblies. The enclosures narrow at one end to form ducts 14*a* and 14*b* which define passages for directing the sounds produced by the loud speaker assemblies in predetermined directions. The speaker system is normally used with an external stereo signal source, and a cable 22 is used to carry the electrical signals from the remote stereo signal source to the speaker system 10.

A loud speaker assembly, as used in connection with the present invention may typically include "woofer", "tweeter" and mid-range components to permit each speaker assembly to reproduce with greater fidelity the sounds represented by a single electrical signal. For stereo use, two such speaker assemblies are generally used, deriving their signals from two separate electrical signals: a right signal and a left signal. As used in connection with the present invention, the term "loud speaker assembly" refers to devices intended for normal operation at relatively high input power levels. Thus, the loud speaker assemblies referred to herein do not include headphones and like devices. The enclosure 12*a* of FIG. 1 may be seen in greater detail in FIG. 2. it is identical to the enclosure 12*b* of FIG. 1.

Figure 2:
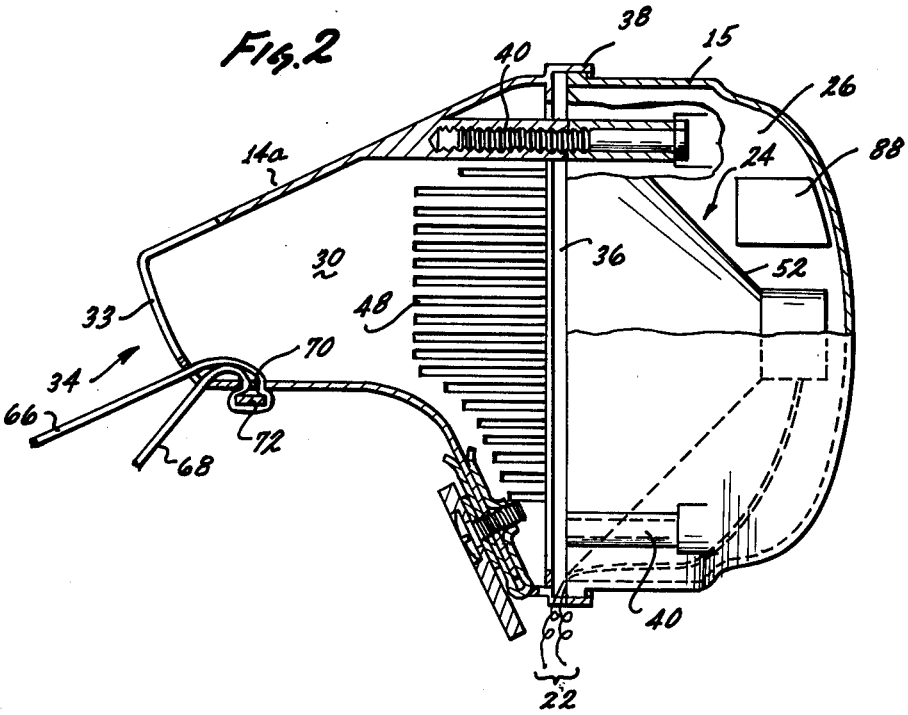
FIG. 2 is a side cross-sectional view of the preferred embodiment taken along the direction indicated by the arrows 2,2 of FIG. 1.

FIG. 2 is a cross-sectional view in a lateral direction shown by the arrows 2—2 of FIG. 1. The enclosure 12*a*, also referred to as a housing, contains a loud speaker assembly 24 of the type described above, and defines a chamber 26 in which the loud speaker assembly is mounted. As shown in FIG. 2, loud speaker assembly 24 occupies a substantial portion of the chamber 26.

Housing 12*a* has a number of holes 46, 47 and 48 on the portion of it adjacent the speaker. These holes provide for a flow of air in and out of chamber 26 as the cone 52 of the loud speaker assembly vibrates. If the holes were not present, the amplitude of vibration would be reduced and the volume of sound produced by the speaker, particularly in the bass range, would be reduced because of the cushioning effect of the air trapped within chamber 26.

Housing 12*a* further includes a duct portion 14*a* which defines a passage 30 connecting the chamber 26 with the space outside the housing. In one embodiment, a plurality of slots 33 in the outer end 34 of the duct 14*a* facilitates transmission of the sound from the duct.

In a preferred embodiment shown in FIG. 2, the front end of the speaker cone 52 is connected to a surrounding rim 36. The speaker enclosure 12*a* is assembled by inserting the rim 36 of the speaker assembly into a rim 38 at the rear edge of duct portion 14*a*. Next, the rear portion 15 of the enclosure 12*a* is slipped over the speaker assembly 24 and into the rim 38. The duct portion and the rear portion of the enclosure are next bolted together by the bolts 40.

In a preferred embodiment, the enclosures 12*a*, 12*b* are pivotally attached to a spacer bar 54, which holds the speakers a predetermined distance apart. The pivotal attachment of the enclosures to the spacer bar 54 permits the speakers to be oriented at predetermined angles about the axis of the screws 58*a* and 58*b*. This permits the longer dimension of the outer portion 34 of the duct to be aligned parallel to the sloping sides of a seat, as shown more clearly in FIG. 7.

Although the spacer bar 54 could consist of a single bar with a number of holes 56 spaced along its longer dimension, in the preferred embodiment, the spacer bar 54 consists of two similar portions 54*a* and 54*b*. As shown in FIG. 1, these portions can be overlapped by predetermined amounts and then connected together by screws or other fasteners to provide a spacer bar whose length is adjustable in accordance with the width of the seat.

In a preferred embodiment, fastener 60 is slipped through aperture 62 and aligned with a hole 64 in the duct portion 14*a* of the enclosure. The screw 58*a* is then passed through the spacer bar 54 to engage the threads of the fastener, thereby attaching the enclosure 12*a* to the spacer bar 54, as shown in FIG. 2.

Figure 7:
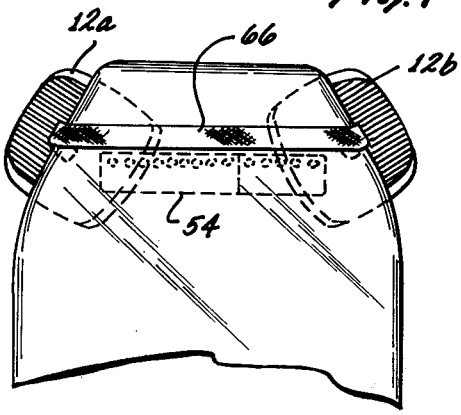
FIG. 7 is a front elevation view of one type of seat back showing a preferred embodiment of the speaker system mounted on it.
Figure 9:
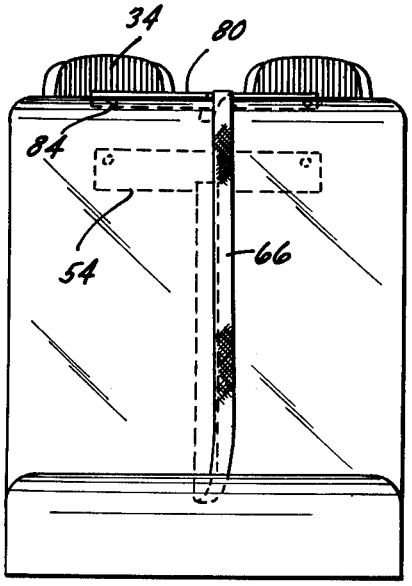
FIG. 9 is a front elevation view of another type of seat back showing an alternative embodiment of the speaker system mounted on it.
Figure 10:
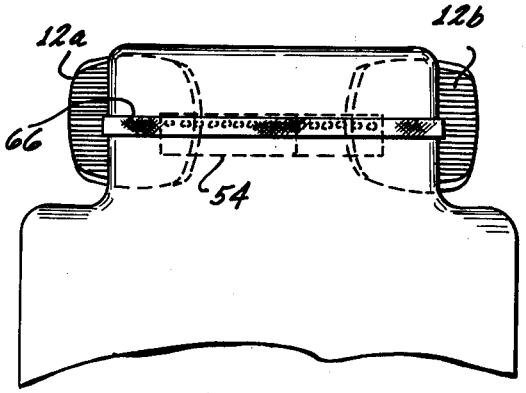
FIG. 10 is a front elevation view of another type of seat back showing a preferred embodiment of the speaker system mounted on it.

The assembly which results when the enclosures 12*a* and 12*b* have been attached to the spacer bar 54 is referred to as the system structure. The stereo speaker system of the present invention further includes a strap for mounting this system structure to the back of a seat. This technique for mounting the stereo speaker system to a seat back is extremely versatile in that it permits reliable mounting to all known types of seat backs, including those which have headrests. FIGS. 7 9 and 10 illustrate the degree of versitility that can be achieved with this preferred embodiment.

Figure 4:
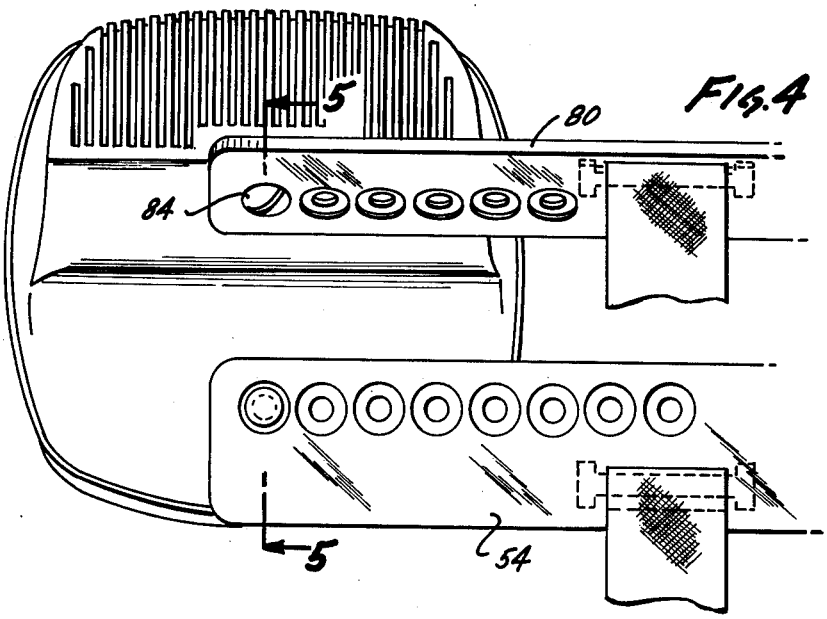
FIG. 4 is a partial front elevation view of an alternative embodiment of the speaker system.
Figure 6:
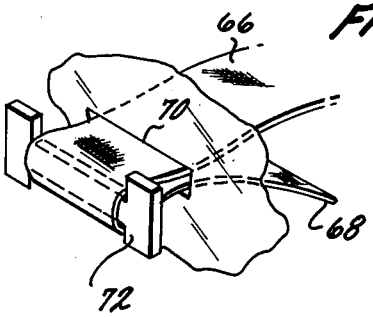
FIG. 6 is a perspective view of the means for attaching a strap to the spacer or to the enclosure of the speaker system in a preferred embodiment.

In the preferred embodiment, a strap 66 may be attached to the system structure at the duct portions of the enclosures or at the spacer bar 54. In a preferred embodiment, the free end 68 of the strap 66 is inserted through a slot 70, passed around an I-shaped part 72 and then passed back through the same slot 70. FIG. 2 shows how the strap is attached to the duct portion 14*a* of the enclosure, and it may also be attached in the same way to the spacer bar through a slot as shown in FIG. 4. The manner in which the strap is attached is shown more clearly in the perspective drawing of FIG. 6.

Figure 3:
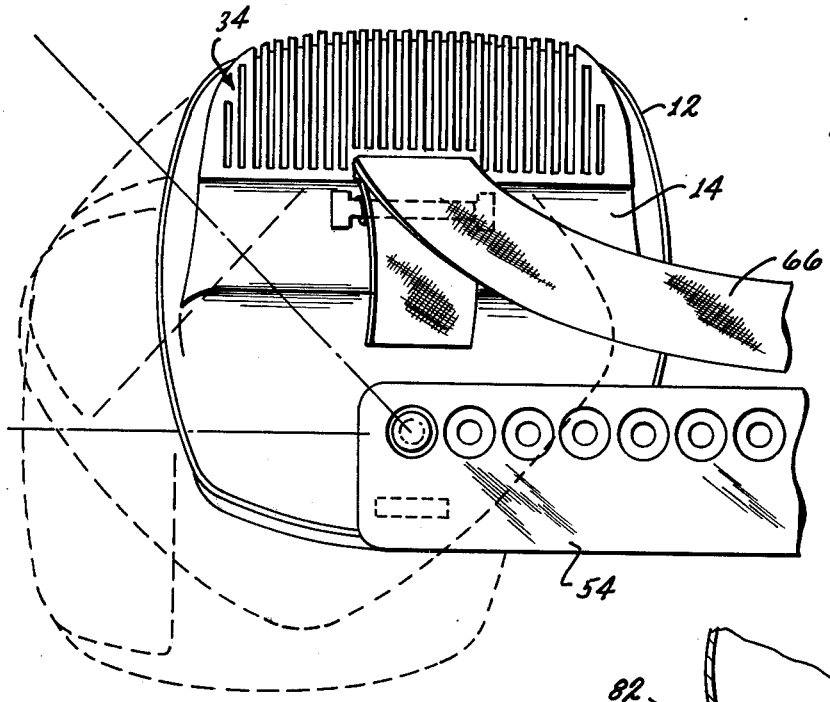
FIG. 3 is a partial front elevation view of a preferred embodiment of the speaker system.
Figure 8:
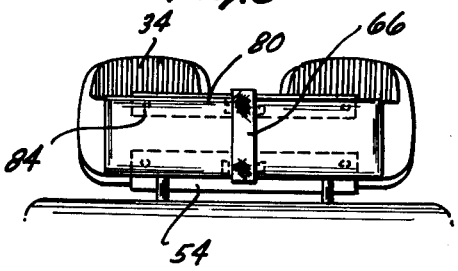
FIG. 8 is a front elevation view of another type of seat back showing an alternative embodiment of the speaker system mounted on it.

As shown in FIG. 3, in a preferred embodiment, each of the enclosures 12 is pivotally attached to the spacer bar 54 to permit the enclosure to be tilted to various orientations as shown by the dashed lines in FIG. 3. In the preferred embodiment shown in FIG. 3, the strap 66 is attached to the outer end 34 of the duct portion 14 of the enclosure. When the strap is attached to the duct portion 14 of the enclosure 12, the system is particularly well adapted for mounting with the longer dimension of the outer end 34 of the duct in an inclined or vertical orientation as shown in FIGS. 7 and 10 respectively. It is seen that in these applications, it is particularly effective to attach the strap 66 to the duct. A glance at FIGS. 8 and 9 suggests that where the longer dimension of the outer end 34 of the duct portion 14 is more easily parallel to the spacer bar 54, it is not expedient to attach the strap to the duct portion. The applications shown in FIGS. 8 and 9 are more expeditiously surmounted by attaching the strap to the spacer bar 54.

Figure 5:
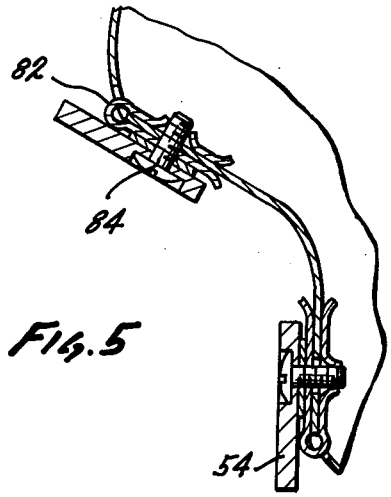
FIG. 5 is a partial cross-sectional side view of the alternative embodiment of FIG. 4.

In applications where it has been determined that the longer dimension of the outer end 34 of the duct is to be oriented parallel to the spacer bar 54, it has been found advantageous to employ an alternative embodiment of the system structure. This alternative embodiment is shown in FIGS. 4, 5, 8 and 9. In that embodiment, a second spacer bar 80 is provided to prevent pivoting of the enclosures. The second spacer bar 80 is, for all practical purposes substantially similar to the spacer bar 54. Like the spacer bar 54, the spacer bar 80 is attached to the duct portion 14 of the enclosure 12 by a fastener 82 and a screw 84. FIGS. 4 and 5 show the manner in which the second spacer bar 80 is attached to the duct portion 14 of the enclosure 12. In the alternative embodiment of FIG. 4, a first end of the strap 66 is attached to the first spacer bar 54, the strap is then passed around a headrest as shown in FIG. 8 or around the entire back of the seat as shown in FIG. 9, and the free end of the strap is then attached to the second spacer bar 80. If the strap is tightened snugly, the system structure will be held securely to the seat back or the headrest.

If the back of the seat has a horizontal top surface which is arched forward at either side, the alternative embodiment of FIG. 4 could be used provided the first spacer bar 54 is omitted and both ends of the strap 66 are secured to the second spacer bar 80. In such an application, the enclosures 12*a* and 12*b* would be "towed-in" somewhat towards the medial plane of the seat.

In other other embodiments, the strap 66 is made of an elastic material which is stretched lengthwise around a portion of the back of the seat. Alternatively, an inelastic strap may be provided with an elastic element such as a spring at some point along its length.

The unique mounting system used in the present invention permits rapid mounting of the system structure to virtually any kind of seat back. Conversely, the system structure can be rapidly removed from the seat back and carried to another location or mounted on a different seatback.

In yet an additional embodiment, a radio receiver 88 of FIG. 2 may be included within one or both of the speaker enclosures, thereby eliminating the necessity for a cable such as cable 22 of FIG. 2, connecting the speaker system with a source of electrical signals.

FIGS. 11 and 12 show an alternative apparatus for mounting the system structure to a seat back. In that embodiment, a bracket 90 is attached to the spacer bar 80 to keep the system in place on the seat back.

The bracket 90 is formed by attaching a forwardly-extending bar 92 to the spacer bar 80, and then attaching a downwardly-extending member 94 to the bar 92 to form the bracket.

The embodiment of FIGS. 11 and 12 is particularly intended for mounting the speaker system structure to non-moving seats, such as the easy chairs used in homes, where it is not necessary to secure the system against forces of acceleration such as are encountered in vehicles.

Thus, there has been described a speaker system having a unique housing, including a duct portion for channeling the sound generated toward the listener's ears.

Unlike headphones, the speaker system does not attach to the listener's head and does not block out external sounds from the listener's ears. This in turn permits a listener who is driving a car to hear the sounds of traffic about him.

The speaker system of the present invention does not restrict the listener's ability to move about, nor does it obscure his vision.

The speaker system disclosed above includes a novel means for mounting the speaker system to an unusually wide variety of seat backs.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A stereo speaker system structure for mounting on the back of a seat which may include a headrest near its top, comprising:

two loud speaker assemblies, each including at least one loud speaker;

an enclosure for each of said loud speaker assemblies, comprising a shell of rigid material substantially surrounding said loud speaker assembly on all sides to form a chamber substantially occupied by said loud speaker assembly and narrowing on one side to form a duct for directing sound produced by said loud speaker assembly;

at least one rigid spacer comprising an elongated member having means for attaching each enclosure to it at a preselected location along its length to form a system structure comprising two of said enclosures held in a spaced-apart relationship by said at least one rigid spacer; and, means for attaching a strap to the system structure for mounting it on the back of a seat.

2. The stereo speaker system structure of claim 1 wherein said at least one rigid spacer comprises a single rigid spacer and wherein each of said enclosures is pivotally attached to said single rigid spacer to permit the enclosures to be oriented to conform to the shape of the back of the seat.

3. The stereo speaker system structure of claim 1 wherein said at least one rigid spacer further comprises two spacer bars each attached to both of said enclosures.

4. The stereo speaker system structure of claim 1 wherein said at least one rigid spacer is adjustable in length in its direction of elongation.

5. The stereo speaker system structure of claim 4 wherein said at least one rigid spacer further comprises two elongated rigid members and means for rigidly connecting them together so that they overlap partially with their elongated dimensions extending in a common direction, whereby the length of said spacer can be adjusted by altering the amount of overlap.

6. The stereo speaker system structure of claim 1 wherein said means for attaching a strap are located on said at least one rigid spacer.

7. The stereo speaker system structure of claim 1 wherein said means for attaching a strap are located on the enclosures.

8. The stereo speaker system structure of claim 1 further comprising a strap attached to said system structure and encircling a portion of the back of the seat for securing the system structure to it.

9. The stereo speaker system structure of claim 8 wherein said strap further comprises an elastic strap.

10. The stereo speaker system structure of claim 8 wherein said strap further comprises an elastic element.

* * * * *